United States Patent [19]

Vorhauer et al.

[11] Patent Number: 4,990,115

[45] Date of Patent: Feb. 5, 1991

[54] BUOYANCY COMPENSATOR WITH EXPANDABLE CUMMERBUND AND AUXILIARY HARNESS

[75] Inventors: Marjorie Vorhauer, Spring Valley; Neil Bergstrom, La Mesa, both of Calif.

[73] Assignee: Soniform, Inc., El Cajon, Calif.

[21] Appl. No.: 369,760

[22] Filed: Jun. 22, 1989

[51] Int. Cl.[5] ..... B63C 11/02

[52] U.S. Cl. ..... 441/111; 441/108

[58] Field of Search ..... 441/80, 89, 106, 108, 441/123, 111–119; 2/2.1 R; 405/185, 116; 128/202.14; 114/315

[56] References Cited

U.S. PATENT DOCUMENTS

| | | | |
|---|---|---|---|
| 1,478,239 | 12/1923 | Marengo | 441/108 |
| 1,862,070 | 6/1932 | Summerson | 441/106 |
| 2,905,954 | 9/1959 | Lanciano | 441/116 |
| 3,877,098 | 9/1975 | Braly | 405/186 |
| 4,137,585 | 2/1979 | Wright | 114/315 |
| 4,194,257 | 3/1980 | Martin | 441/108 |
| 4,496,328 | 1/1985 | Asher | 441/55 |
| 4,523,914 | 6/1985 | Faulconer | 441/108 |
| 4,561,853 | 12/1985 | Faulconer | 441/106 |
| 4,694,772 | 9/1987 | Faulconer | 114/315 |
| 4,778,307 | 10/1988 | Faulconer | 405/186 |
| 4,779,554 | 10/1988 | Courtney | 405/186 |
| 4,810,134 | 3/1989 | Faulconer | 405/186 |
| 4,887,932 | 12/1989 | Totti | 405/186 |

*Primary Examiner*—Joseph F. Peters, Jr.
*Assistant Examiner*—Clifford T. Bartz

[57] ABSTRACT

A buoyancy compensator is provided with an expandable cummerbund and an auxiliary harness which is attached to the cummerbund. The buoyancy compensator comrpises a vest having a back portion, right and left shoulder flaps, and right and left front portions. A cummerbund includes an elastic central portion which is attached to the back portion and a pair of non-elastic end portions. The cummerbund is adapted to be secured about the waist of the wearer and can expand and contract as the wearer changes his elevation in the water. An auxiliary harness is provided by a pair of straps which are attached to the end portions of the cummerbund and which can be releasably connected to the shoulder portions.

10 Claims, 4 Drawing Sheets

BUOYANCY COMPENSATOR WITH EXPANDABLE CUMMERBUND AND AUXILIARY HARNESS

BACKGROUND AND SUMMARY

This invention relates to buoyancy compensators, more particularly, to a buoyancy compensator with an expandable cummerbund and an auxiliary harness.

Buoyancy compensators are commonly provided in a form similar to a life vest and include a bladder inside the vest. Buoyancy compensators are described, for example, in U.S. Pat. Nos. 4,694,772, 4,561,853, 4,523,914, and 4,137,585.

A buoyancy compensator is used by a scuba diver to adjust his buoyancy during a dive. The bladder can be inflated with air to increase the diver's buoyancy and deflated when the diver wants to descend to a lower level.

The invention provides a buoyancy compensator with an expandable cummerbund or waist band and an auxiliary harness for assisting in supporting the weight of the breathing air tank. The cummerbund includes an elastic middle portion which is attached to the back portion of the buoyancy compensator and a pair of relatively non-elastic end portions which are adapted to be secured around the waist of the diver. An auxiliary harness strap extends upwardly from each of the end portions of the cummerbund toward the shoulder portion of the buoyancy compensator and is releasably connected to the shoulder portion by buckles.

DESCRIPTION OF THE DRAWING

The invention will be explained in conjunction with an illustrative embodiment shown in the accompanying drawing, in which.

DESCRIPTION OF SPECIFIC EMBODIMENTS

Figure 3:
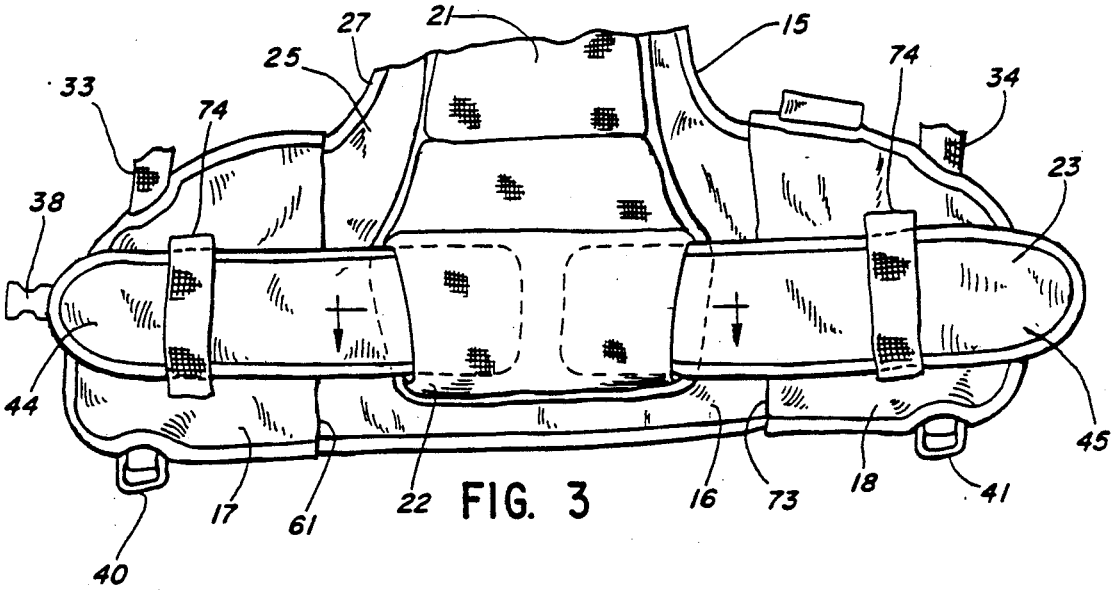
FIG. 3 is a fragmentary plan view of the buoyancy compensator showing the cummerbund open.
Figure 5:
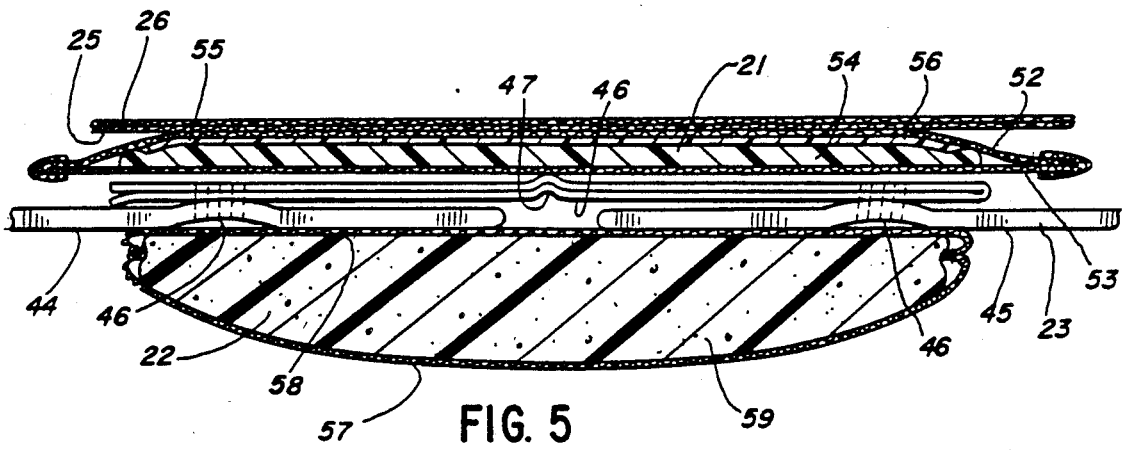
FIG. 5 is a fragmentary sectional view taken along the line 5—5 of FIG. 3.
Figure 6:
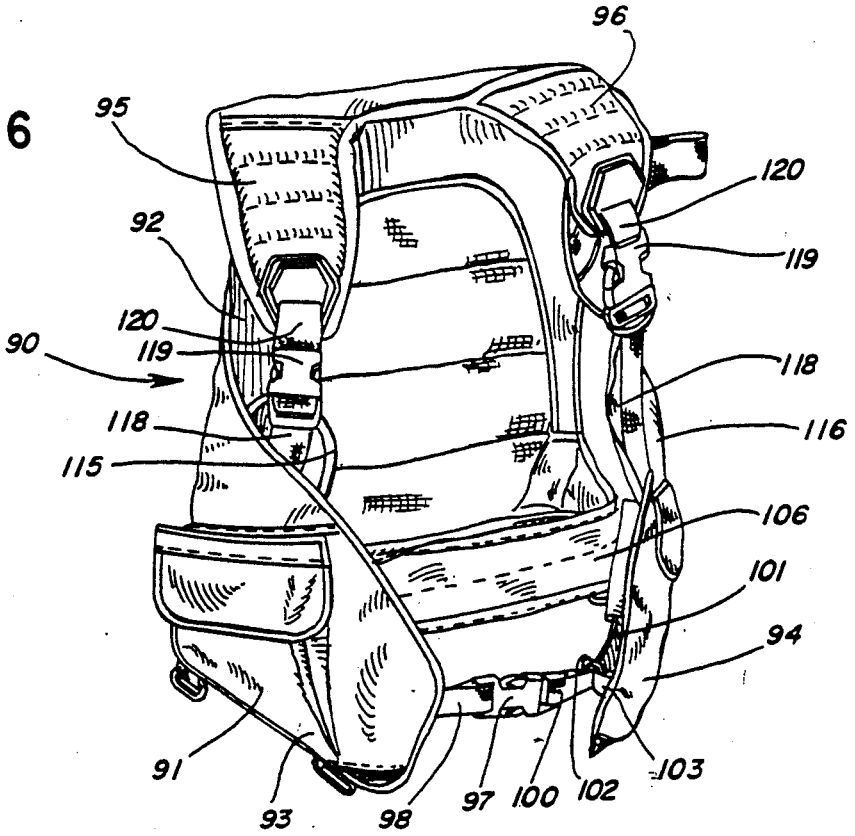
FIG. 6 is a view similar to FIG. 1 of a buoyancy compensator with an auxiliary harness attached to the cummerbund.
Figure 7:
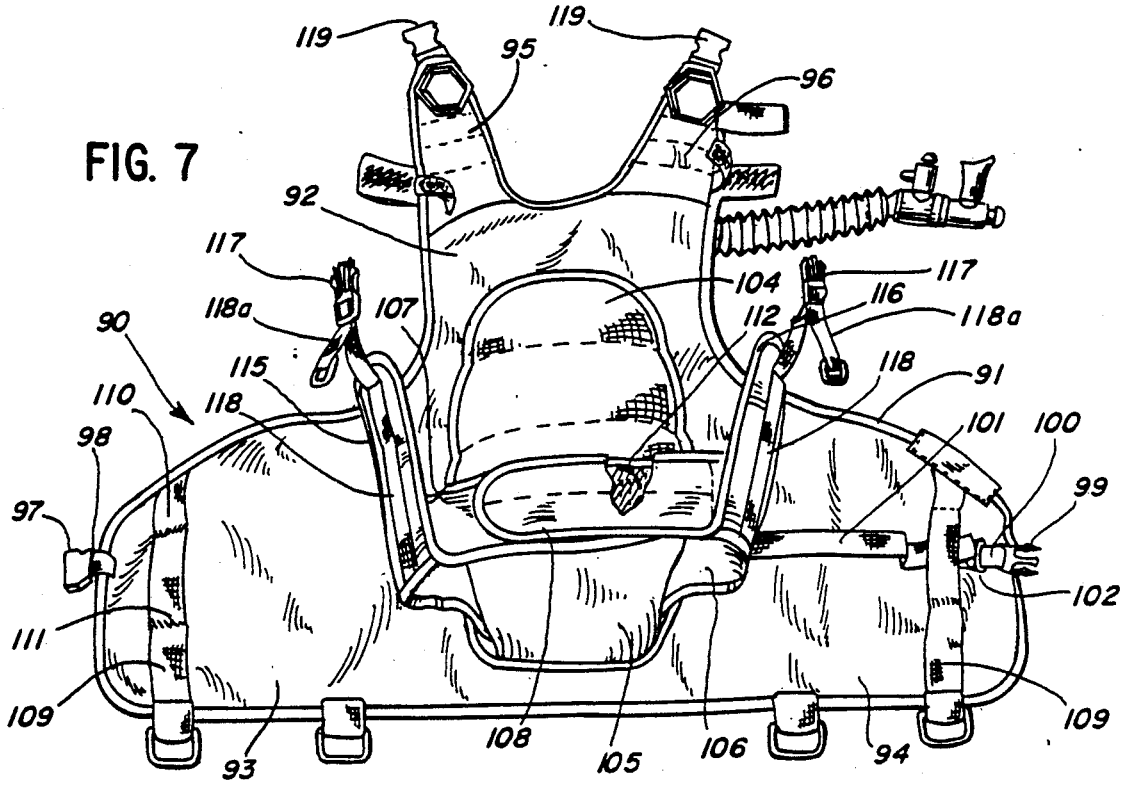
FIG. 7 is a view similar to FIG. 2 of the buoyancy compensator of FIG. 6.
Figure 8:
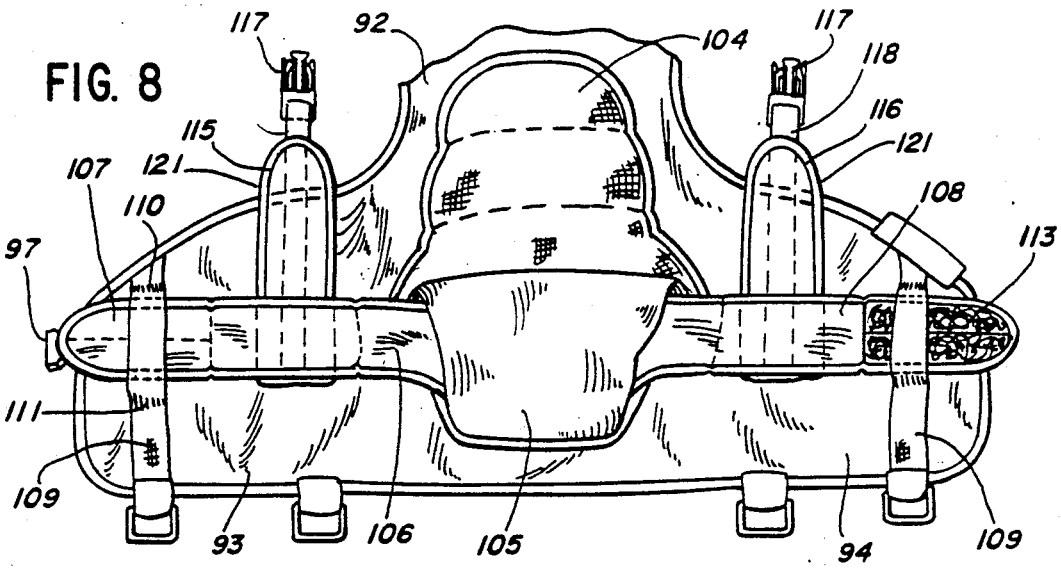
FIG. 8 is a view similar to FIG. 3 of the buoyancy compensator of FIG. 6.

The numeral 14 designates generally a buoyancy compensator which includes a vest 15 having a back portion 16, right and left side flaps 17 and 18, and right and left shoulder portions 19 and 20. A back pad 21 is attached to the inside surface of the back and includes an enlarged lumbar pad 22 (FIGS. 3 and 5). A cummerbund or waist band 23 is attached to the back portion behind the lumbar pad. Conventional means for mounting a tank of compressed breathing gas can be mounted on the outside surface of the back portion.

The vest is formed from two layers of nylon fabric 25 and 26 (FIG. 5) which are secured around their edges by a binding 27 which is stitched to the fabric layers. The fabric layers enclose a conventional air bladder which can either be provided separately or can be formed by an air-impermeable layer on the inside of the fabric. In the latter case, the vest is formed from thermoplastic coated nylon pack cloth which is electronically heat-sealed together. The coating seals the fabric and creates an air chamber when the two layers are welded together. The bladder is inflated by a conventional inflator tube 28 (see FIG. 2) which is well known in the art.

Straps 30 and 31 are attached to the right and left shoulder flaps, respectively, and each of the straps include a conventional quick release female buckle 32. Vertical straps 33 and 34 are attached to the right and left side flaps 17 and 18, and each of the straps includes a conventional quick release male buckle 35 which is adapted to connect to one of the female buckles 32. Horizontal straps 36 and 37 are attached to the ends of the side flaps and include female and male buckles 38 and 39, respectively, which are adapted to connect together. D-rings 40 and 41 are attached to the lower edges of the side flaps.

Figure 4:
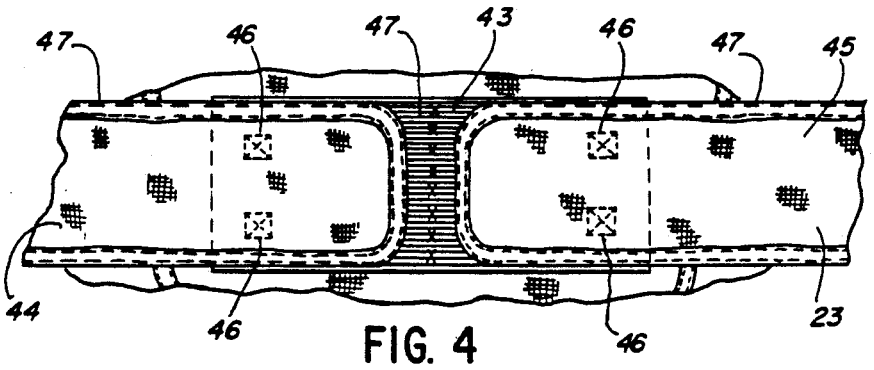
FIG. 4 is a fragmentary view showing the central portion of the cummerbund.

The cummerbund 23 includes an elastic middle portion 43 (FIGS. 4 and 5) and right and left end portions 44 and 45. Referring to FIG. 5, the elastic middle portion is provided by a double layer of elastic fabric, and each of the end portions 44 and 45 are stitched to the elastic fabric and two rectangular areas 46. The center of the elastic fabric 43 is stitched at 47 to the back pad 21. Each of the end portions 44 and 45 of the cummerbund is advantageously formed from two layers of non-elastic nylon fabric and an edge binding 47 which is stitched together around the periphery of the fabric. The three ends of the end portions 44 and 45 include mating hook and loop fasteners 48 and 49, respectively (see FIG. 2). The hook and loop fasteners can be of the type which is sold under the trademark Velcro.

Still referring to FIG. 5, the back pad 21 includes inner and outer layers 52 and 53 and a cushion 54. The outer layer 53 is attached to the inner layer of the vest by two lines of stitching 55 and 56. The lumbar pad 22 includes inner and outer layers 57 and 58 which enclose a cushion 59.

Figure 1:
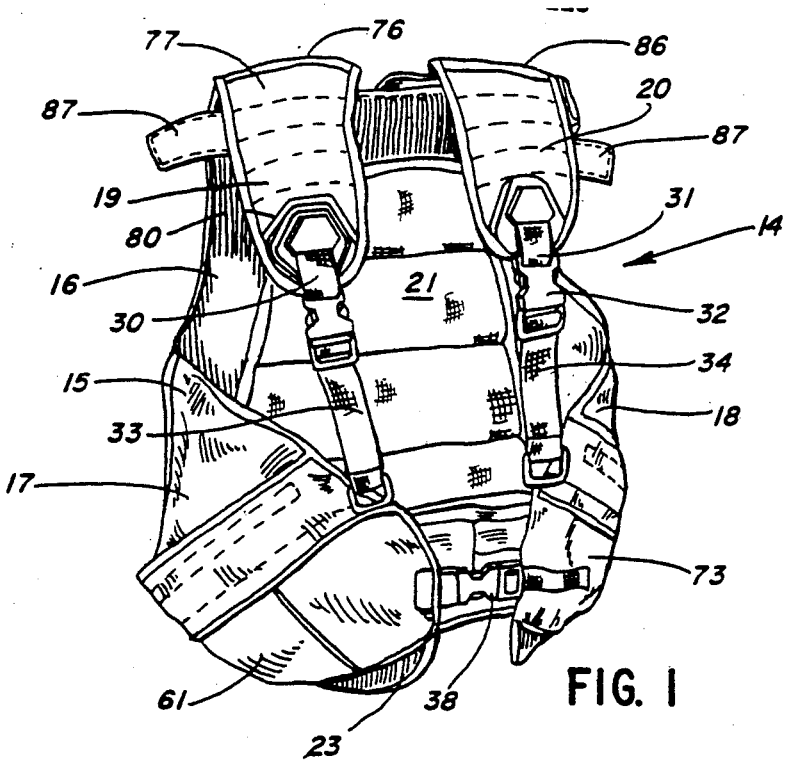
FIG. 1 is a perspective view of a buoyancy compensator.
Figure 2:
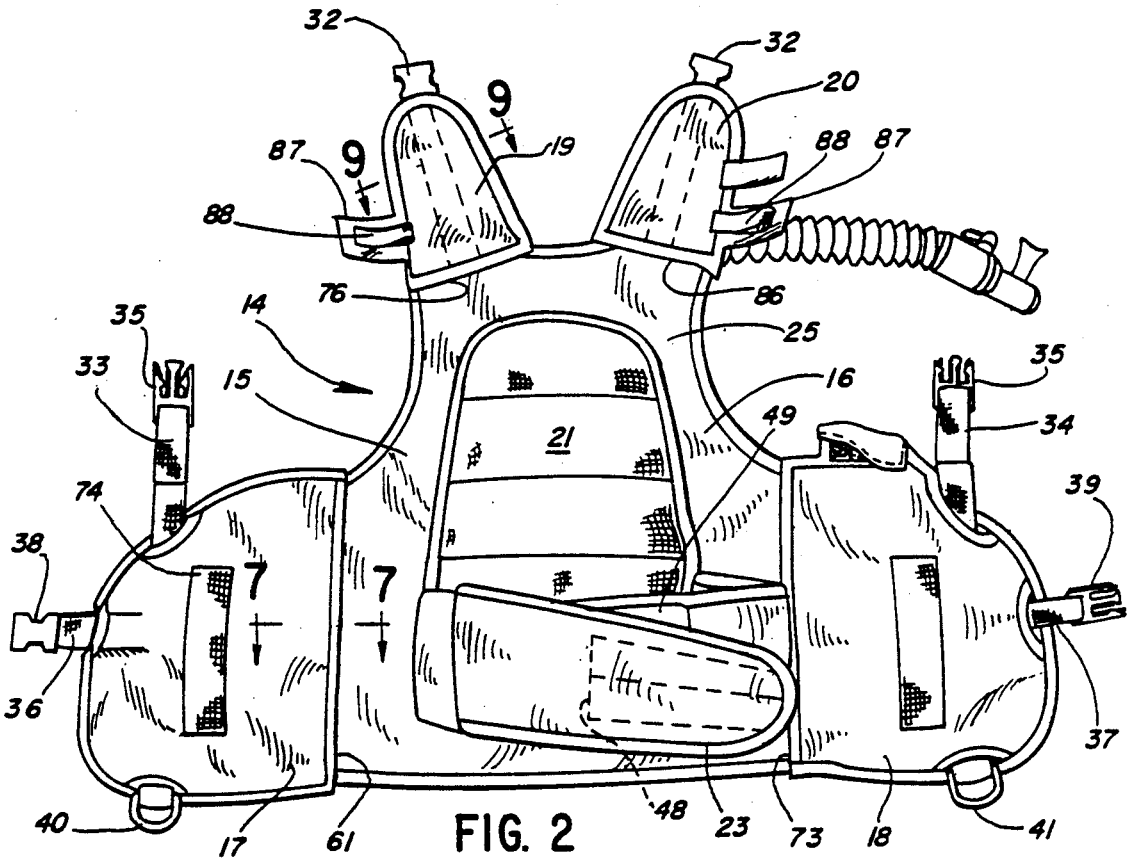
FIG. 2 is a plan view of the buoyancy compensator of FIG. 1.

The particular buoyancy compensator illustrated in FIGS. 1–3 includes removable side flap pockets 61 and 73 and removable shoulder flap pockets 76 and 86 which are described in detail in the co-pending patent application Ser. No. 370,271 entitled "Buoyancy Compensator with Interchangeable Accessories" filed of even date herewith. The end portions of the cummerbund extend through straps 74 which are attached to the side flap pockets 61 and 73. The straps 30 and 31 which are secured to the shoulder flaps 19 and 20 extend through openings 80 in the shoulder flap pockets 76 and 86. Each of the shoulder flap pockets is provided with a pair of complementary hook and loop fastener tabs 87 and 88 for securing breathing tubes or the like.

The diver inflates or deflates the bladder of the buoyancy compensator through the inflater tube 28 in the conventional manner in order to adjust his buoyancy. As the bladder is inflated and deflated, the diver adjusts the straps which connect the side flaps and shoulder flaps in order to retain the buoyancy compensator comfortably and snugly about his body. Also, as the diver descends or ascends during a dive, compression on his wet suit increases or decreases, which may also require adjustment of the straps. However, since the cummerbund includes the elastic central portion 43, the length of the cummerbund automatically adjusts by expansion or contraction of the elastic portion, and the diver does not have to adjust the cummerbund.

Referring now to FIGS. 6–9, a buoyancy compensator 90 includes a vest 91 which is similar to the vest 15 but does not include the removable pockets for the side flaps and shoulder flaps. The vest 91 includes a back portion 92, right and left side flaps 93 and 94, and right and left shoulder flaps 95 and 96. A female buckle 97 is attached to the right side flap by a strap 98. A mating male buckle 99 is connected to a short elastic strap 100 which is stitched to an adjustable strap 101. The strap 101 is connected to the back portion 92 and extends through a ring 102 which is attached to the end of the left side flap by a strap 103.

A back pad 104 is attached to the inside surface of the back portion 92 and includes a lumbar pad 105. A cummerbund 106 extends between the lumbar pad 105 and the back pad 104. The cummerbund 106 is similar to the cummerbund 23 and includes an elastic central portion (not shown) which is stitched to the back pad behind the lumbar pad and right and left end portions 107 and 108. Each of the end portions 107 and 108 extends between a pair of superposed straps 109 which are attached to the associated side flap 93 or 94. The upper and lower ends of the straps 109 are stitched to the side flap, and the straps are stitched together by two lines of stitching 110 and 111 which are spaced apart slightly greater than the width of the cummerbund so that the end portions of the cummerbund can slide freely between the two straps. A hook and loop fastener 112 (FIG. 7) is attached to the end portion 107 of the cummerbund, and a hook and loop fastener 113 (FIG. 8) is attached to the end portion 108 of the cummerbund so that the end portions can be secured around the waist of a diver.

An auxiliary harness strap 115 is secured to the right end portion 107 of the cummerbund and extends generally upwardly toward the right shoulder portion 95 of the vest. An auxiliary harness strap 116 is attached to the left end portion 108 of the cummerbund and extends generally upwardly toward the left shoulder flap 96. In the embodiment illustrated the auxiliary harness straps 115 and 116 extend at right angles to the cummerbund. However, the straps can also extend at an acute angle to the cummerbund.

A male buckle 117 is attached to each of the auxiliary harness straps 115 and 116 by a strap 118. Each of the straps 118 is stitched to the auxiliary harness strap along substantially the entire length of the auxiliary harness strap to provide a secure attachment. The male buckles 117 mate with female buckles 119 which are attached to the ends of the right and left shoulder flaps 95 and 96 by straps 120. Each of the auxiliary harness straps is formed by two layers of nylon fabric and a binding 121 which extends around the periphery of the straps and is secured by stitching.

Figure 9:
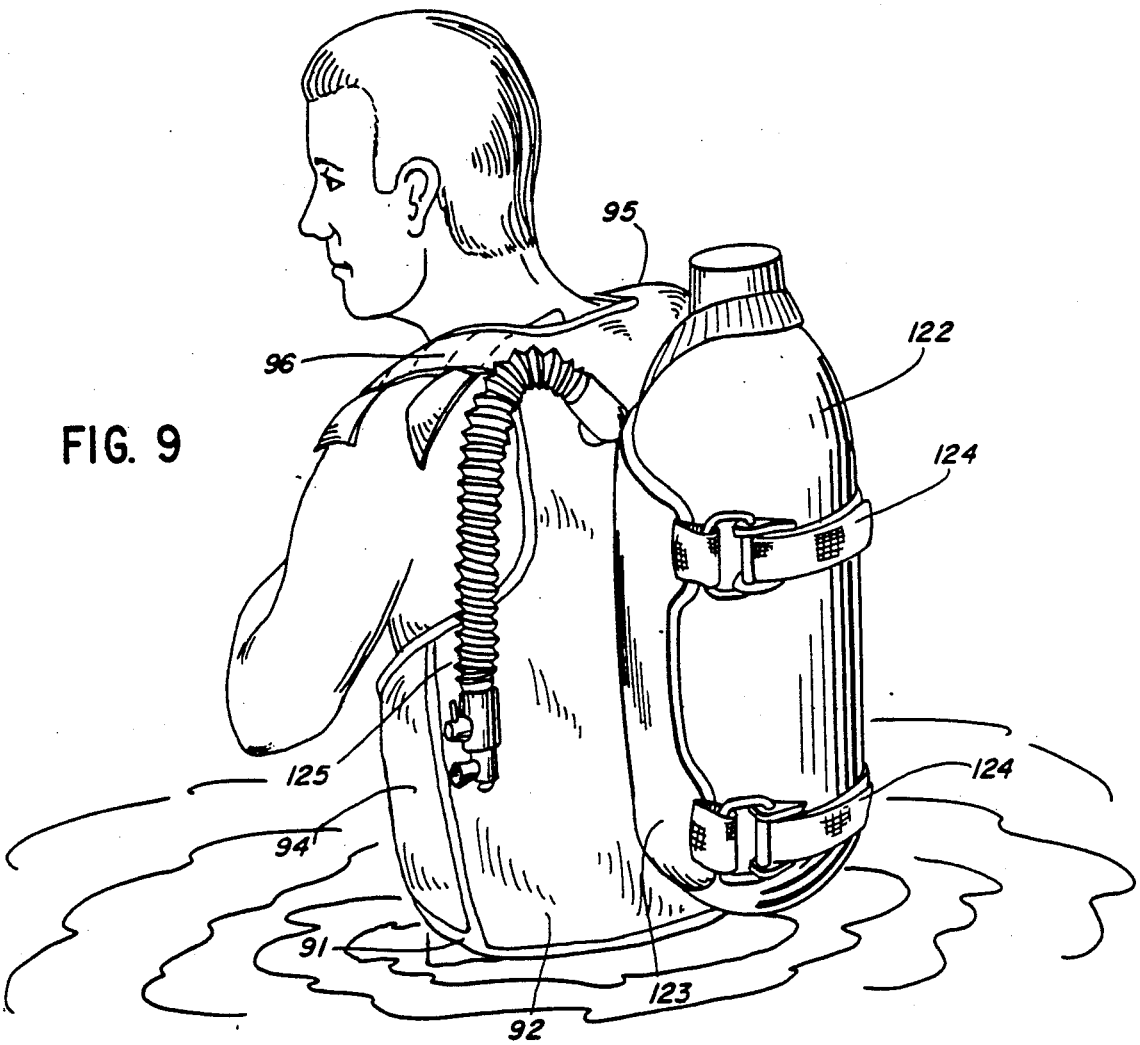
FIG. 9 is a perspective view of a diver wearing the buoyancy compensator of FIG. 6.

Referring to FIG. 9, a tank 122 of compressed breathing gas is mounted on the back portion 92 of the buoyancy compensator by a tank harness 123 which is secured to the back portion. The tank harness 123 is a conventional "softpack" configuration available from Soniform, Inc. and includes straps 124 for releasably securing the tank within the harness. A conventional inflater tube 125 is used to inflate or deflate the bladder within the vest.

The diver dons the buoyancy compensator 90 by wrapping the end portions 107 and 108 of the cummerbund around his waist and securing the hook and loop fasteners 112 and 113. The ends of the side flaps 93 and 94 are releasably connected by connecting the buckles 97 and 99.

The right and left auxiliary harness straps 115 and 116 are releasably connected to the right and left shoulder straps 95 and 96 by connecting the buckles 117 and 119. The tension on the straps 118 to which the buckles 117 are attached can be adjusted by pulling on the ends 118*a* (FIG. 7) of the straps which are threaded through the attaching portions of the buckles 117. By virtue of the connection between the auxiliary harness straps 115 and 116 and the shoulder flaps 95 and 96, a substantial portion of the weight of the breathing tank 122 is transferred to the cummerbund.

As described previously, the elastic central portion of the cummerbund expands and contracts as the diver moves to different depths in the water, and the cummerbund does not have to be adjusted. The side flaps 93 and 94 can also move toward or away from each other by virtue of the short elastic strap 100 which is attached to the buckle 99. The breathing tank is always supported in a stable manner by the auxiliary harness straps and the cummerbund as the diver ascends or descends without having to adjust the cummerbund.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A buoyancy compensator comprising a vest having a back portion, a pair of shoulder portions, and a pair of front portions, the back portion having an outside surface and an inside surface adapted to face the back of a wearer, a cummerbund attached to the inside surface of the back portion and adapted to encircle the waist of the wearer, the cummerbund including a central portion formed of elastic material which is secured to the back portion and a pair of end portions formed of relatively non-elastic material which are secured to the elastic portion.

2. The buoyancy compensator of claim 1 including a strap attached to each of the end portions of the cummerbund and extending toward one of the shoulder portions, and fastening means for releasably connecting each of said straps to one of the shoulder portions.

3. The buoyancy compensator of claim 1 in which the end portions of the cummerbund are formed of non-elastic fabric material.

4. The buoyancy compensator of claim 2 in which each of said fastening means includes a buckle part on the strap and a mating buckle part on the associated shoulder portion.

5. A buoyancy compensator comprising: a vest having a back portion; a pair of should portion; a pair of front portions; the back portion having an outside surface and an inside surface adapted to face the back of a wearer; a cummerbund attached to the inside surface of the back portion and adapted to encircle the waist of the wearer; the cummerbund including a central portion formed of elastic material which is secured to the back portion and a pair of end portions which are secured to the elastic portion; and a sleeve surrounding the elastic central portion of the cummerbund and attached to the back portion of the buoyancy compensator.

6. The buoyancy compensator of claim 5 including a lumbar pad on the sleeve adapted to contact the lumbar region of a wearer.

7. A buoyancy compensator comprising a vest having a back portion, right and left side flaps, and right and left shoulder flaps, the back portion having an outside surface and an inside surface adapted to face the back of the wearer, means on the outside surface of the back portion for supporting a tank of compressed gas, a cummerbund attached to the inside surface of the back portion and adapted to encircle the waist of a wearer, the cummerbund having a central portion attached to the back portion and right and left end portions, means for releasably connecting the right and left end portions, a first strap attached to the right end portion of the cummerbund and extending toward the right shoulder flap, a second strap attached to the left end portion of the cummerbund and extending toward the left shoulder flap, means for releasably connecting the first strap and the right shoulder flap, and means for releasably connecting the second strap and the left shoulder flap whereby a portion of the weight of the tank is supported by the cummerbund.

8. The buoyancy compensator of claim 7 in which the cummerbund includes an elastic central portion which is secured to the back portion.

9. The buoyancy compensator of claim 7 in which each of said means for releasably connecting the straps and the shoulder flaps include a buckle part on the strap and a mating buckle part on the associated shoulder flap.

10. The buoyancy compensator of claim 7 in which each of said straps comprises a double layer of fabric.

* * * * *

UNITED STATES PATENT AND TRADEMARK OFFICE

CERTIFICATE OF CORRECTION

PATENT NO. : 4,990,115

DATED : February 5, 1991

INVENTOR(S) : Marjorie Vorhauer et al

It is certified that error appears in the above-identified patent and that said Letters Patent is hereby corrected as shown below:

Col. 4, line 61 change "should portion" to --shoulder portions--.

Signed and Sealed this

Twenty-first Day of July, 1992

*Attest:*

DOUGLAS B. COMER

*Attesting Officer*

*Acting Commissioner of Patents and Trademarks*